US005893396A

United States Patent [19]

Vagle

[11] Patent Number: 5,893,396

[45] Date of Patent: Apr. 13, 1999

[54] HEIGHT ADJUSTABLE STANDPIPE

[75] Inventor: Wesley Duane Vagle, Burnsville, Minn.

[73] Assignee: BJ Industries, Inc., Burnsville, Minn.

[21] Appl. No.: 08/811,832

[22] Filed: Mar. 5, 1997

[51] Int. Cl.[6] ..... F16L 11/00

[52] U.S. Cl. ..... 138/120; 4/645; 138/155; 285/32; 285/302

[58] Field of Search ..... 4/645; 285/32, 285/302; 138/155, 120, 177, 178

[56] References Cited

U.S. PATENT DOCUMENTS

| | | | |
|---|---|---|---|
| 717,533 | 1/1903 | Brandt . | |
| 1,385,262 | 7/1921 | Nebel . | |
| 1,391,091 | 9/1921 | Arbuckle . | |
| 1,406,426 | 2/1922 | Stewart . | |
| 1,864,184 | 6/1932 | Cavert . | |
| 2,716,757 | 9/1955 | Eriksson . | |
| 2,817,094 | 12/1957 | Lessley . | |
| 2,958,871 | 11/1960 | Eskenazi et al. . | |
| 3,011,177 | 12/1961 | Haughey . | |
| 3,118,147 | 1/1964 | Larkin . | |
| 3,456,264 | 7/1969 | Flagg . | |
| 3,473,173 | 10/1969 | Maciulaitis et al. . | |
| 3,486,175 | 12/1969 | Schwartz . | |
| 4,233,693 | 11/1980 | Stocklöw . | |
| 4,328,597 | 5/1982 | Bodin . | |
| 4,497,511 | 2/1985 | Barker . | |
| 4,543,677 | 10/1985 | Haglund et al. | 138/155 X |
| 4,807,834 | 2/1989 | Cohen . | |
| 5,050,253 | 9/1991 | Wasek . | |
| 5,160,174 | 11/1992 | Thompson . | |
| 5,230,109 | 7/1993 | Zaccai et al. . | |

*Primary Examiner*—William Stryjewski
*Attorney, Agent, or Firm*—Chad A. Klingbeil; Moore & Hansen

[57] ABSTRACT

The height adjustable standpipe includes multiple, cylindrical, coaxial drain sections of gradually diminishing cross section. The sections preferably alternate between brass and PVC plastic, and have grooves adjacent the ends of the PVC sections for retaining O-rings that serve as gaskets between the two adjacent sections. Thus, for example, a PVC section would preferably have one or two peripheral grooves on the outer surface near the end that passes inside of the next adjacent brass section, and the same PVC section would have one or two peripheral grooves on the inner surface near the opposite end, through which passes another brass section. Each of these peripheral grooves includes a rubber O-ring seated therein and projecting therefrom to form a water-tight seal with the adjacent surface of the brass section engaged by that end of the PVC section. A travel stop mechanism is employed to limit the travel of the sections of the adjustable standpipe with respect to one another.

14 Claims, 4 Drawing Sheets

HEIGHT ADJUSTABLE STANDPIPE

BACKGROUND OF THE INVENTION

1. Technical Field

The present invention relates generally to a standpipe attachable to the drain of a sink that permits adjustment of the height of the sink itself. In particular, the standpipe may be lengthened or shortened to accommodate different sink positions.

2. Background Information

The need for an adjustable standpipe attachable to the drain of a sink has long been recognized. However, the challenge of an adequate solution has always been difficult to find. For primarily sanitary reasons, it has been difficult to find a solution that is reliable, clean and safe.

The uses for such a device are many. For example, a height adjustable standpipe may be quite valuable in conjunction with sinks or basins used by people of varying heights or limited physical abilities. Obviously, the scene of a child standing on his or her tiptoes trying to reach the water faucet is a familiar one to those with families having small children. Perhaps less familiar but even more problematic are those situations where the sink or basin is used both by able-bodied people and also those with certain physical challenges. In particular, senior citizens who are restricted to a wheelchair may find it extremely inconvenient, if not impossible, to reach the faucet of a sink or basin that is intended to accommodate an able-bodied person of average adult height.

Another particular problem faced by some physically challenged people is how to shampoo the hair of a person who is restricted to a wheelchair. Shampoo bowls, which are designed with a large opening in the front to accommodate the head and neck of a person leaning backwards in a reclining position, are usually positioned at a fixed height. Such shampoo bowls are intended to be used with chairs that may be moved up and down. However, if a person is restricted to a wheelchair, they may not have the ability to adjust their position relative to the shampoo bowl. It is desirable to allow the shampoo bowl to be adjusted to accommodate that person whose range of motion is severely limited.

The height adjustable standpipe of the present invention overcomes difficulties described above and affords other features and advantages heretofore not available.

SUMMARY OF THE INVENTION

The height adjustable standpipe includes multiple, cylindrical, coaxial drain sections of gradually diminishing cross section. The sections preferably alternate between brass and PVC plastic, and have grooves adjacent the ends of the PVC sections for retaining O-rings that serve as gaskets between the two adjacent sections. Thus, for example, a PVC section would preferably have one or two peripheral grooves on the outer surface near the end that passes inside of the next adjacent brass section, and the same PVC section would have one or two peripheral grooves on the inner surface near the opposite end, through which passes another brass section. Each of these peripheral grooves includes a rubber O-ring seated therein and projecting therefrom to form a water-tight seal with the adjacent surface of the brass section engaged by that end of the PVC section. A travel stop mechanism is employed to limit the travel of the sections of the adjustable standpipe with respect to one another.

Preferably, the travel stop mechanism includes small pins that are fixedly attached adjacent to the upper edge of the outer surfaces of the alternating sections. Small diameter flexible cable sections are attached to the pins to ensure that the adjoining sections are not accidentally removed one from another.

It is an object of this invention to provide a standpipe attachable to a sink or basin to permit the sink or basin to be easily vertically adjusted. It is another object of this invention to provide such a standpipe that satisfies building codes, and is sanitary and reliable. It is a further object of this invention to provide height adjustable fixtures, including shampoo bowls, in combination with the adjustable standpipe, to accommodate the limitations of those with certain physical limitations.

Other objects and advantages of the invention will become apparent from the following detailed description and from the appended drawings in which like numbers have been used to describe like parts throughout the several views.

DESCRIPTION OF THE PREFERRED EMBODIMENT

Figure 1:
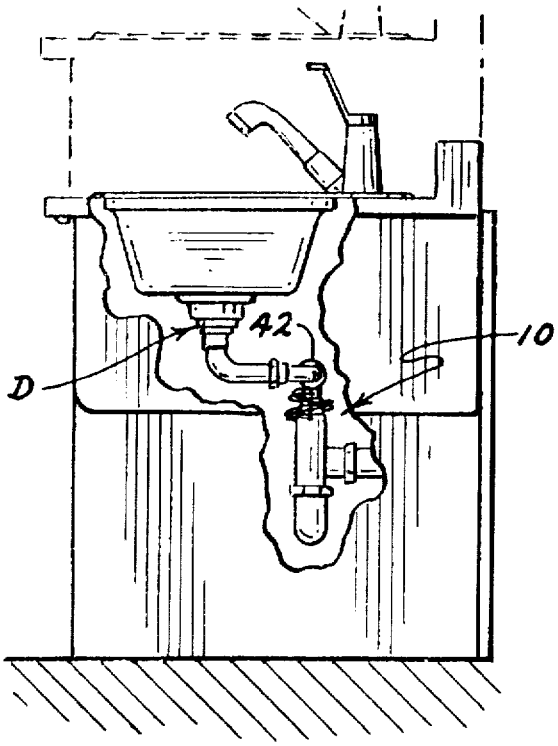
FIG. 1 is a side, cut-away view of a sink with the height adjustable standpipe in the fully retracted position.
Figure 2:
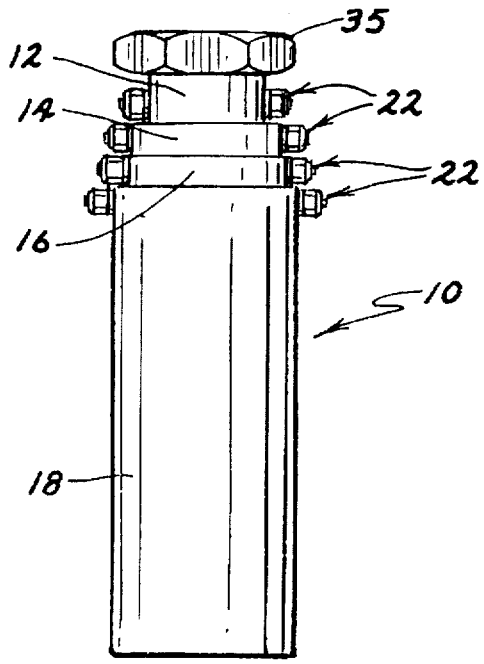
FIG. 2 is a front view of the adjustable standpipe in the fully retracted position.
Figure 3:
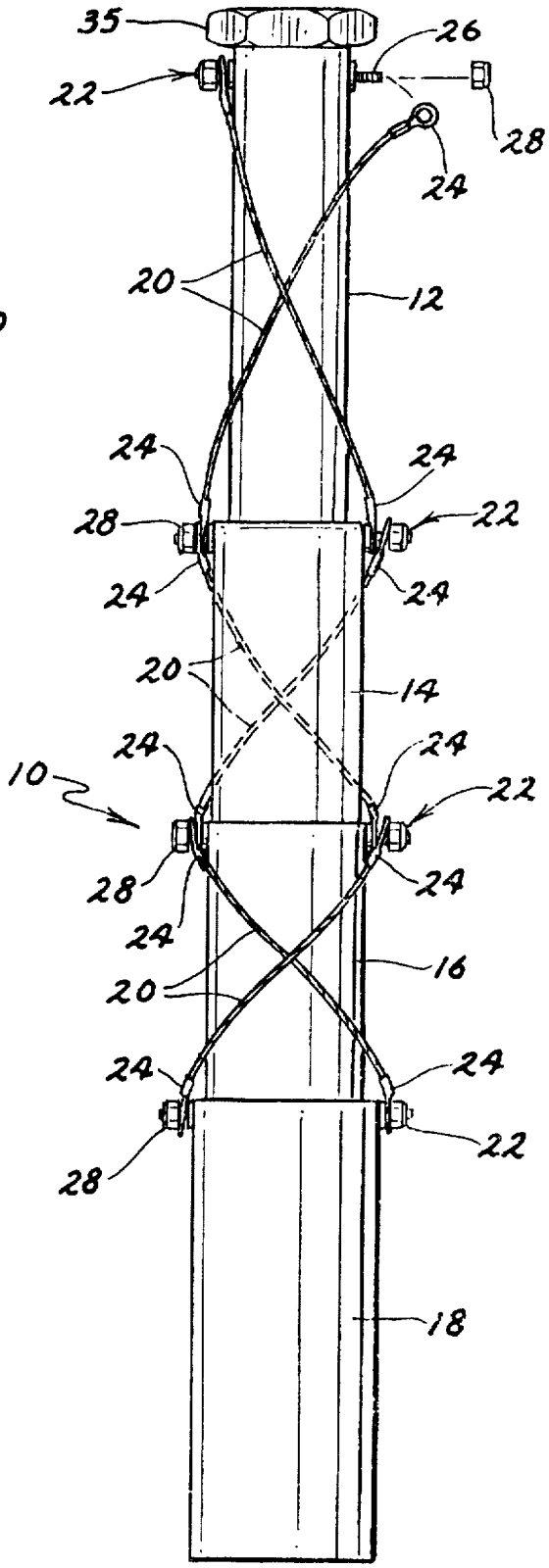
FIG. 3 is a front view of the adjustable standpipe in the fully extended position.
Figure 9:
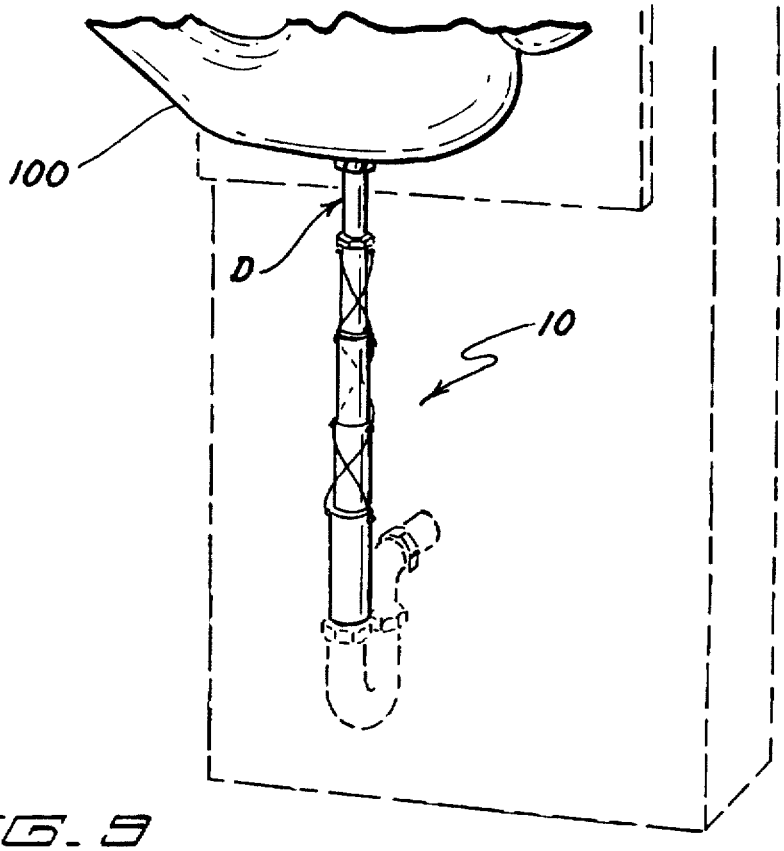
FIG. 9 is a view of the shampoo bowl shown in FIG. 8 in the fully extended position.
Figure 8:
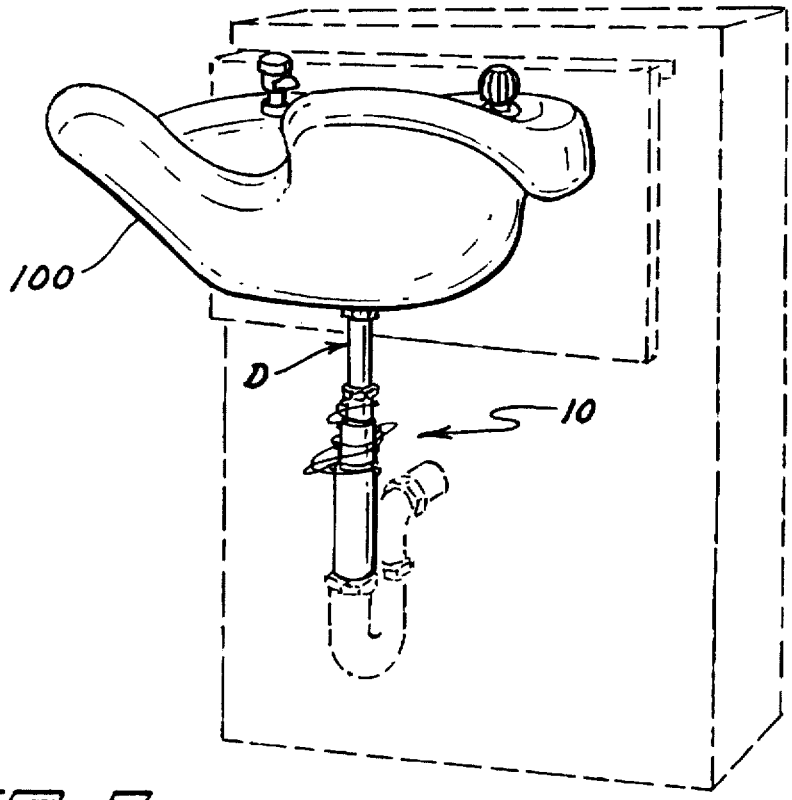
FIG. 8 is a perspective view of a shampoo bowl using the present invention, in the lowered position.

With reference to the drawings, and in particular to FIGS. 1–3, the height adjustable standpipe is generally indicated by reference numeral 10. As shown in FIGS. 1, 8 and 9, height adjustable standpipe 10 works in cooperation with conventional drain assemblies or fixtures D depending from the drain opening of a single- or multiple-basin sink for a bathroom or kitchen. FIGS. 2 and 3 illustrate more of the details of the construction of adjustable standpipe 10, including first, second, third and fourth pipe sections 12, 14, 16 and 18, respectively. Pipe sections 12, 14, 16 and 18 are restrained from extending one from another by restraining means such as cable members 20 held in position by fasteners 22. Cable members 20, preferably made of 1/16 inch plastic coated aircraft cable, include attachment means such as loops 24 on each end. Fasteners 22 preferably include threaded sections 26 over which pass loops 24 of cable members 20, which are then retained in position by locknuts 28. Cable members 20 are an appropriate length for preventing a pipe section from being inadvertently removed from an adjacent pipe section when extending, or lengthening, standpipe 10.

Pipe sections 12, 14, 16 and 18 of standpipe 10 alternate between different materials. For example, pipe sections 12 and 16 are preferably made of brass, while pipe sections 14 and 18 are preferably made of PVC plastic. On sections of standpipe 10 made of PVC plastic, threaded section 26 may threadedly engage the wall of the standpipe section. Threaded section 26 is retained in position by a second nut 30. On sections of standpipe 10 made of brass, threaded section 26 threadedly engages second nut 30, and the resulting assembly is fixedly attached to the outer side of the section wall as by soldering or welding.

Figure 4:
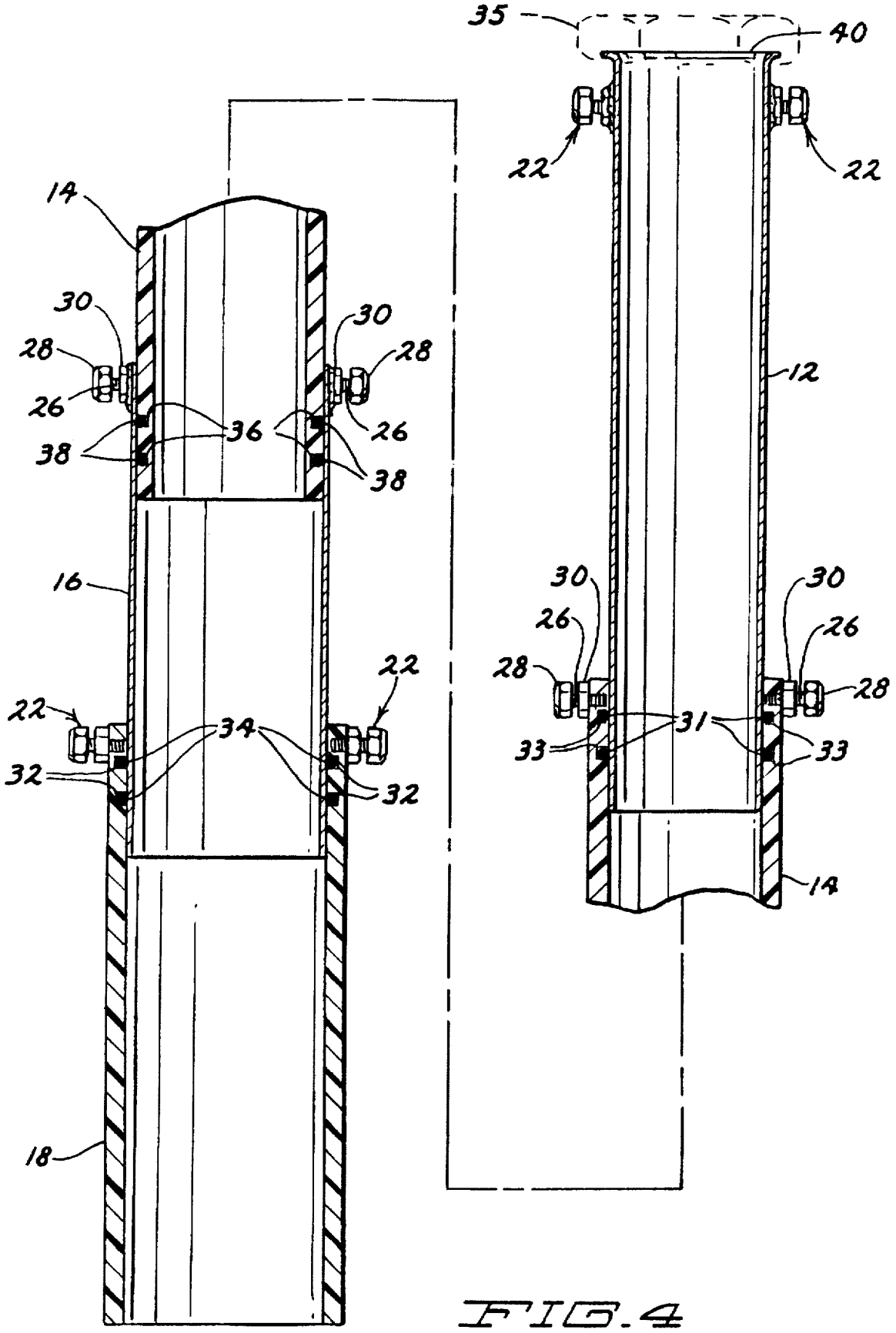
FIG. 4 is a front section view adjustable standpipe in the fully extended position.

As discussed above, and most clearly illustrated with reference to FIG. 4, the sections of adjustable standpipe 10 are preferably made of different materials. In particular, first pipe section 12, also referred to as the tailpiece, and third pipe section 16 are preferably made of brass, and second and fourth pipe sections 14, 18, respectively, are preferably made of PVC plastic. On second section 14, internal annular grooves 31 are positioned adjacent the ends to which fasteners 22 are attached. Contained within grooves 31 are O-rings 33, which frictionally engage the external surfaces of brass section 12. Similarly, on fourth section 18, internal annular grooves 32 are positioned adjacent the ends to which fasteners 22 are attached. Contained within grooves 32 are O-rings 34, which frictionally engage the external surface of brass section 16. Because the diameter of second section 14 is less than that of fourth section 18, the diameter of annular grooves 31 and O-rings 33 are also correspondingly smaller than the diameter of annular grooves 32 and O-rings 34. The positioning of O-rings 33, 34 within annular grooves 31, 32, respectively, serves to prevent backfeeding of fluids flowing down through standpipe 10. Tailpiece 12 also preferably includes a flanged lip 40 for retaining threaded slipnut 35 thereto, for engagement with drain assembly D.

Similarly, second pipe section 14 contains external annular grooves 36 adjacent the end opposite that to which fasteners 22 are attached. Contained within grooves 36 are O-rings 38, which slidably engage the internal surface of brass section 16. The position of O-rings 38 within annular grooves 36 also serves to prevent backfeeding of fluids flowing down through standpipe 10. Adjustable standpipe 10 should be used in a vertical orientation only.

Figure 5:
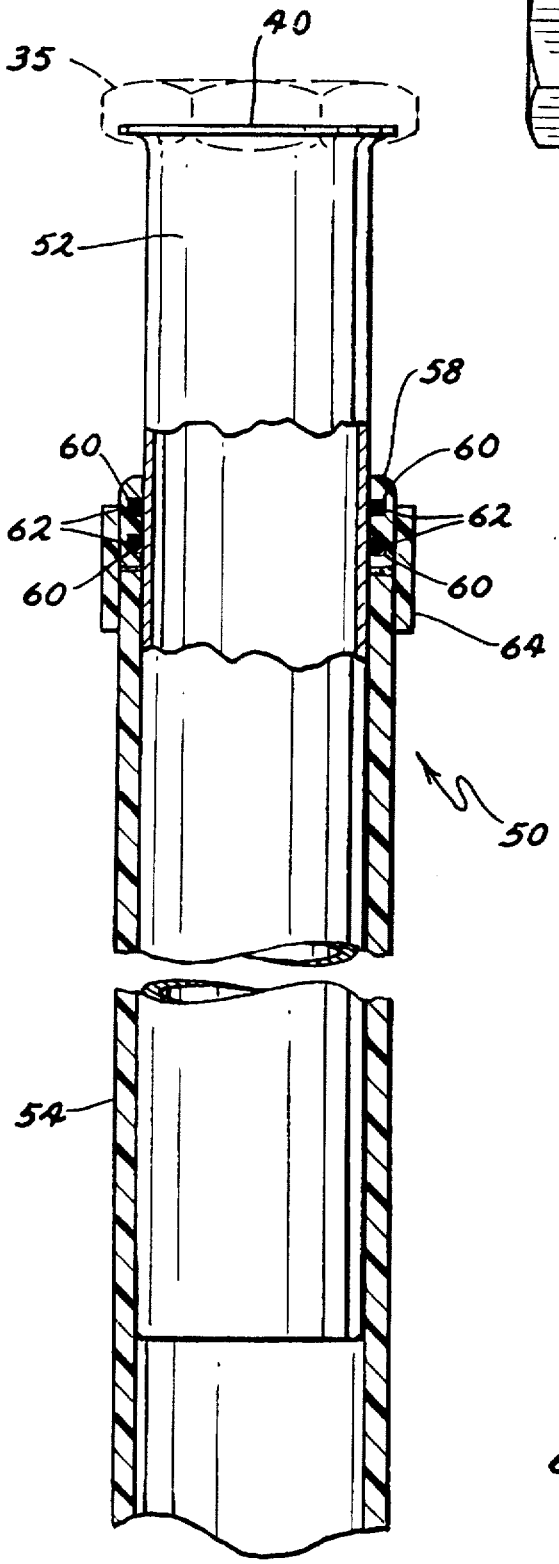
FIG. 5 is a partial section view of a first alternative embodiment of the adjustable standpipe in the extended position.

FIG. 5 illustrates an alternative embodiment of the adjustable standpipe. In FIG. 5, adjustable standpipe 50 includes a brass tailpiece 52 and a lower PVC section 54. A seal assembly 56 includes a PVC pipe section 58 preferably having two internal, annular grooves 60 for receiving two O-rings 62. PVC pipe section 58 and lower PVC section 54 are retained in position by a PVC coupling 64, with the lower end of PVC pipe section 58 preferably fixedly attached as by glue welding to the top end of lower PVC section 54. Tailpiece 52 also preferably includes a flanged lip 40 for retaining threaded slipnut 35 thereto, for engagement with drain assembly D. Adjustable standpipe 50 should be used in a vertical orientation only.

Figure 6:
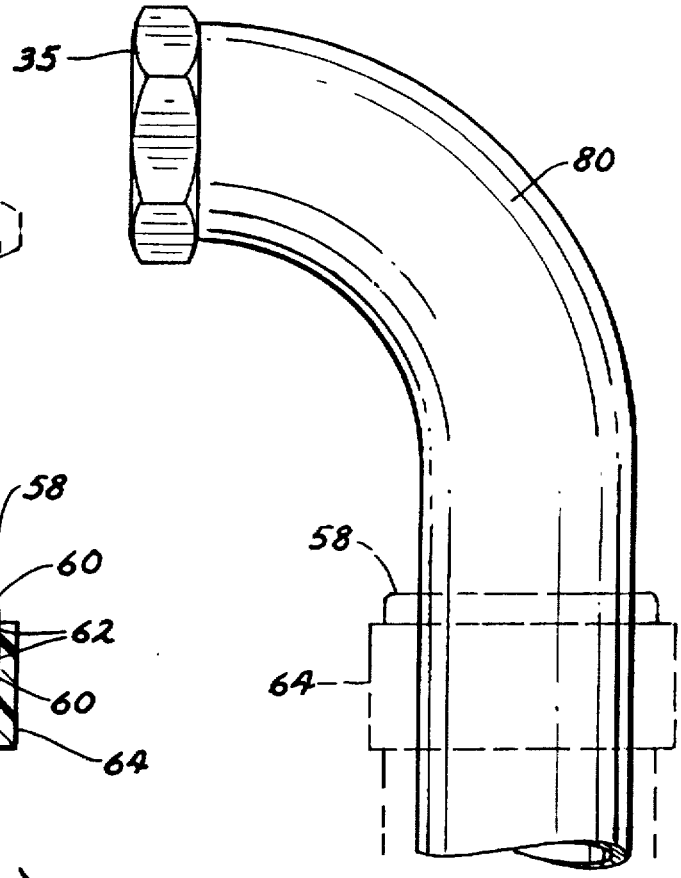
FIG. 6 is a partial section view of the adjustable standpipe with a first alternative tailpiece.
Figure 7:
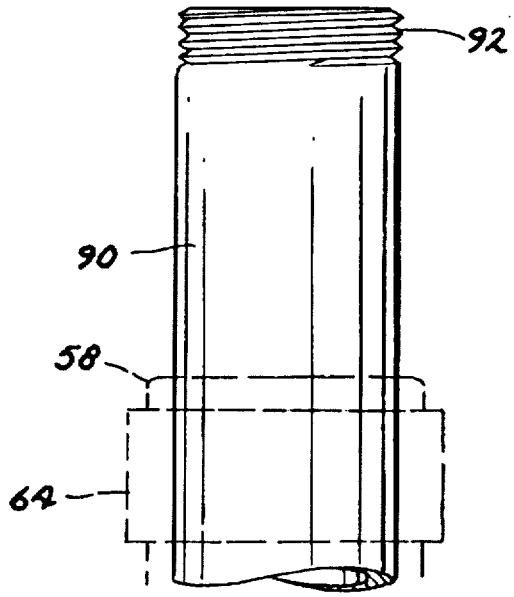
FIG. 7 is a partial section view of the adjustable standpipe with a second alternative tailpiece.

FIG. 6 illustrates an alternative tailpiece 80 having a ninety degree bend. Tailpiece 80 includes a flanged lip (not shown) and slipnut 35 for attachment to a horizontal line coming from, for example, a sink having two basins. Similarly, FIG. 7 illustrates a second alternative embodiment tailpiece 90 having a threaded end 92. Alternative tailpieces 80, 90 may be used in conjunction with the embodiment of adjustable standpipe 10 illustrated in FIGS. 2–4, or with the embodiment of adjustable standpipe 50 illustrated in FIG. 5.

As shown in FIGS. 8 and 9, adjustable standpipe 10 may be attached to the drain assembly D of a shampoo bowl 100.

This application is especially important, for example, for residents of nursing homes who have limited mobility and range of motion, and who could not otherwise comfortably be serviced by a stationary shampoo bowl.

While the preferred embodiments of the invention have been described, it should be understood that various changes, adaptations and modifications may be made therein without departing from the spirit of the invention and the scope of the appended claims.

What is claimed is:

1. A height adjustable standpipe assembly, usable with a conventional single- or multiple-basin sink, the sink having a drain opening with a drain fixture attached thereto, the height adjustable standpipe also communicating with a waste assembly for draining to a sanitary sewer system, the height adjustable standpipe assembly comprising:

a plurality of cylindrical pipe sections of incrementally varying diameters including a first pipe section and a last pipe section, each said pipe section having a first end and a second end, said first end of said first pipe section being removably attachable to the drain fixture of the sink, said second end of each said pipe section being smaller in diameter than and slidably receivable within said first end of the next adjacent said pipe section, and said last pipe section being removably attachable to the waste assembly;

restraining means for restraining a said pipe section within a next adjacent said pipe section, said restraining means preventing said second end of said pipe section from being inadvertently withdrawn from said first end of said next adjacent pipe section, said restraining means comprising first and second cable members, each said cable member having a first end and a second end, and first and second fastening members attached to said outer surface of each said pipe section for attachment and retention of said cable members, said first and second fastening members being diametrically displaced one from another, said fastening members being attached to said respective pipe sections adjacent to said first end thereof, said first end of said first cable member being attached to said first fastening member of one said pipe section, said second end of said first cable member being attached to said second fastening member of a next said pipe section, said first end of said second cable member being attached to said second fastening member of said one pipe section, and said second end of said second cable member being attached to said first fastening member of said next pipe section, whereby upon extension of one said pipe section from a next said pipe section, said one pipe section is restrained from being fully withdrawn from said next pipe section; and gasket means between said ends of said respective pipe sections, whereby waste materials are prevented from leaking from the standpipe assembly.

2. The height adjustable standpipe assembly described in claim 1, further comprising:

second, third and fourth cylindrical pipe sections, each said pipe section having a first end and a second end, each said pipe section having an inner surface and an outer surface, said first pipe section being smaller in diameter than said second pipe section, said second pipe section being smaller in diameter than said third pipe section, and said third pipe section being smaller in diameter than said fourth pipe section, and said second end of said fourth pipe section being removably attachable to the waste assembly.

3. The height adjustable standpipe assembly described in claim 2, wherein said second and fourth pipe sections are made of PVC plastic.

4. The height adjustable standpipe assembly described in claim 3, wherein said gasket means comprises:

at least one annular groove on said interior surface of said second pipe section and adjacent to said first end thereof, and at least one annular groove on said interior surface of said fourth pipe section and adjacent to said first end thereof;

an O-ring positioned in each of said at least one annular grooves on said interior surface of said second pipe section, and an O-ring positioned in each of said at least one annular grooves on said interior surface of said fourth pipe section, whereby said O-rings are fixedly retained within said interior annular grooves of said second and fourth pipe sections, respectively, and slidably engage said exterior surfaces of said first and third pipe sections, respectively;

at least one annular groove on said exterior surface of said second pipe section and adjacent to said second end thereof; and an O-ring positioned in each of said at least one annular grooves on said exterior surface of said second pipe section, whereby said O-rings are fixedly retained within said exterior annular grooves of said second section and slidably engages said interior surface of said third pipe section.

5. A height adjustable standpipe and sink assembly, the sink having a drain opening with a drain fixture attached thereto, the height adjustable standpipe also communicating with a waste assembly for draining to a sanitary sewer system, the height adjustable standpipe assembly comprising:

first, second, third and fourth cylindrical pipe sections, each said pipe section having a first end and a second end, each said pipe section having an interior surface and an exterior surface, said first pipe section being smaller in diameter than said second pipe section, said second pipe section being smaller in diameter than said third pipe section, and said third pipe section being smaller in diameter than said fourth pipe section, said first end of said first pipe section being removably attachable to the drain fixture of the sink, and said second end of said fourth pipe section being removably attachable to the waste assembly;

restraining means for restraining a said pipe section within a next adjacent said pipe section, said restraining means preventing said second end of said pipe section from being inadvertently withdrawn from said first end of said next adjacent pipe section, said restraining means comprising first and second cable members, each said cable member having a first end and a second end, and first and second fastening members attached to said outer surface of each said pipe section for attachment and retention of said cable members, said first and second fastening members being diametrically displaced one from another, said fastening members being attached to said respective pipe sections adjacent to said first end thereof, said first end of said first cable member being attached to said first fastening member of one said pipe section, said second end of said first cable member being attached to said second fastening member of a next said pipe section, said first end of said second cable member being attached to said second fastening member of said one pipe section, and said second end of said second cable member being attached to said first fastening member of said next pipe section, whereby upon extension of one said pipe section from a next said pipe section, said one pipe section is restrained from being fully withdrawn from said next pipe section;

gasket means between said ends of said respective pipe sections, whereby waste materials are prevented from leaking from the standpipe assembly; and a sink member.

6. The height adjustable standpipe assembly described in claims 5, wherein said sink member is a shampoo bowl.

7. The height adjustable standpipe assembly described in claim 5, wherein said second and fourth pipe sections are made of PVC plastic.

8. The height adjustable standpipe assembly described in claim 7, wherein said gasket means comprises:

at least one annular groove on said interior surface of said second pipe section and adjacent to said first end thereof, and at least one annular groove on said interior surface of said fourth pipe section and adjacent to said first end thereof;

an O-ring positioned in each of said at least one annular grooves on said interior surface of said second pipe section, and an O-ring positioned in each of said at least one annular grooves on said interior surface of said fourth pipe section, whereby said O-rings are fixedly retained within said interior annular grooves of said second and fourth pipe sections, respectively, and slidably engage said exterior surfaces of said first and third pipe sections, respectively;

at least one annular groove on said exterior surface of said second pipe section and adjacent to said second end thereof; and O-ring positioned in each of said at least one annular grooves on said exterior surface of said second pipe section, whereby said O-rings are fixedly retained within said exterior annular grooves of said second section and slidably engages said interior surface of said third pipe section.

9. A height adjustable standpipe assembly, usable with a conventional single- or multiple-basin sink, the sink having a drain opening with a drain fixture attached thereto, the height adjustable standpipe also communicating with a waste assembly for draining to a sanitary sewer system, the height adjustable standpipe assembly comprising:

a plurality of cylindrical pipe sections of incrementally varying diameters including a first pipe section and a last pipe section, each said pipe section having a first end and a second end, each said pipe section having an interior surface and an exterior surface, said first end of said first pipe section being removably attachable to the drain fixture of the sink, said second end of each said pipe section being smaller in diameter than and slidably receivable within said first end of the next adjacent said pipe section, and said last pipe section being removably attachable to the waste assembly;

at least one annular groove on said interior surface of said last pipe section and adjacent to said first end thereof;

an O-ring positioned in each of said at least one annular grooves on said interior surface of said last pipe section, whereby said O-rings are fixedly retained within said interior annular grooves and slidably engage said exterior surface of said first pipe section to prevent waste materials from leaking from the standpipe assembly; and a sink member.

10. A height adjustable standpipe assembly, usable with a conventional single- or multiple-basin sink, the sink having a drain opening with a drain fixture attached thereto, the height adjustable standpipe also communicating with a waste assembly for draining to a sanitary sewer system, the height adjustable standpipe assembly comprising:

first, second, third and fourth cylindrical pipe sections of incrementally varying diameters, each said pipe section having a first end and a second end, each said pipe section having an interior surface and an exterior surface, said first end of said first pipe section being removably attachable to the drain fixture of the sink, said second end of each said pipe section being smaller in diameter than and slidably receivable within said first end of the next adjacent said pipe section, and said fourth pipe section being removably attachable to the waste assembly;

said second and fourth pipe sections are made of PVC plastic;

restraining means for restraining a said pipe section within a next adjacent said pipe section, said restraining means preventing said second end of said pipe section from being inadvertently withdrawn from said first end of said next adjacent pipe section;

at least one annular groove on said interior surface of said second pipe section and adjacent to said first end thereof, and at least one annular groove on said interior surface of said fourth pipe section and adjacent to said first end thereof;

an O-ring positioned in each of said at least one annular grooves on said interior surface of said second pipe section, and an O-ring positioned in each of said at least one annular grooves on said interior surface of said fourth pipe section, whereby said O-rings are fixedly retained within said interior annular grooves of said second and fourth pipe sections, respectively, and slidably engage said exterior surfaces of said first and third pipe sections, respectively, to prevent waste materials from leaking from the standpipe assembly;

at least one annular groove on said exterior surface of said second pipe section and adjacent to said second end thereof; and an O-ring positioned in each of said at least one annular grooves on said exterior surface of said second pipe section, whereby said O-rings are fixedly retained within said exterior annular grooves of said second section and slidably engage said interior surface of said third pipe section to prevent waste materials from leaking from the standpipe assembly.

11. The height adjustable standpipe assembly described in claim 10, wherein said restraining means comprises:

first and second cable members, each said cable member having a first end and a second end; and first and second fastening members attached to said outer surface of each said pipe section for attachment and retention of said cable members, said first and second fastening members being diametrically displaced one from another, said fastening members being attached to said respective pipe sections adjacent to said first end thereof, said first end of said first cable member being attached to said first fastening member of one said pipe section, said second end of said first cable member being attached to said second fastening member of a next said pipe section, said first end of said second cable member being attached to said second fastening member of said one pipe section, and said second end of said second cable member being attached to said first fastening member of said next pipe section, whereby upon extension of one said pipe section from a next said pipe section, said one pipe section is restrained from being fully withdrawn from said next pipe section.

12. A height adjustable standpipe and sink assembly, the sink having a drain opening with a drain fixture attached thereto, the height adjustable standpipe also communicating with a waste assembly for draining to a sanitary sewer system, the height adjustable standpipe assembly comprising:

first, second, third and fourth cylindrical pipe sections, each said pipe section having a first end and a second end, each said pipe section having an interior surface and an exterior surface, said first pipe section being smaller in diameter than said second pipe section, said second pipe section being smaller in diameter than said third pipe section, and said third pipe section being smaller in diameter than said fourth pipe section, said first end of said first pipe section being removably attachable to the drain fixture of the sink, and said second end of said fourth pipe section being removably attachable to the waste assembly;

said second and fourth pipe sections are made of PVC plastic;

restraining means for restraining a said pipe section within a next adjacent said pipe section, said restraining means preventing said second end of said pipe section from being inadvertently withdrawn from said first end of said next adjacent pipe section;

at least one annular groove on said interior surface of said second pipe section and adjacent to said first end thereof, and at least one annular groove on said interior surface of said fourth pipe section and adjacent to said first end thereof;

an O-ring positioned in each of said at least one annular grooves on said interior surface of said second pipe section, and an O-ring positioned in each of said at least one annular grooves on said interior surface of said fourth pipe section, whereby said O-rings are fixedly retained within said interior annular grooves of said second and fourth pipe sections, respectively, and slidably engage said exterior surfaces of said first and third pipe sections, respectively, to prevent waste materials from leaking from the standpipe assembly;

at least one annular groove on said exterior surface of said second pipe section and adjacent to said second end thereof;

an O-ring positioned in each of said at least one annular grooves on said exterior surface of said second pipe section, whereby said O-rings are fixedly retained within said exterior annular grooves of said second section and slidably engages said interior surface of said third pipe section to prevent waste materials from leaking from the standpipe assembly; and a sink member.

13. The height adjustable standpipe assembly described in claim 12, wherein said sink member is a shampoo bowl.

14. The height adjustable standpipe assembly described in claim 12, wherein said restraining means comprises:

first and second cable members, each said cable member having a first end and a second end; and first and second fastening members attached to said outer surface of each said pipe section for attachment and retention of said cable members, said first and second fastening members being diametrically displaced one from another, said fastening members being attached to said respective pipe sections adjacent to said first end thereof, said first end of said first cable member being attached to said first fastening member of one said pipe section, said second end of said first cable member being attached to said second fastening member of a next said pipe section, said first end of said second cable member being attached to said second fastening member of said one pipe section, and said second end of said second cable member being attached to said first fastening member of said next pipe section, whereby upon extension of one said pipe section from a next said pipe section, said one pipe section is restrained from being fully withdrawn from said next pipe section.

* * * * *

UNITED STATES PATENT AND TRADEMARK OFFICE

CERTIFICATE OF CORRECTION

PATENT NO. : 5,893,396

DATED : April 13, 1999

INVENTOR(S) : Wesley Duane Vagle

It is certified that error appears in the above-identified patent and that said Letters Patent is hereby corrected as shown below:

In column 6, line 11, before the number 5 delete the word "claim" and insert the word --claims--.
In column 6, line 35, before the word O-ring insert the word --an--.

Signed and Sealed this

Twenty-seventh Day of July, 1999

*Attest:*

Q. TODD DICKINSON

*Attesting Officer*

*Acting Commissioner of Patents and Trademarks*